US005613507A

United States Patent [19]

Geer et al.

[11] Patent Number: 5,613,507

[45] Date of Patent: Mar. 25, 1997

[54] APPARATUS FOR CREATING SCULPTURED NAILS

[75] Inventors: Janice F. Geer; James W. Geer, both of San Antonio, Tex.

[73] Assignee: Superb Solutions

[21] Appl. No.: 527,948

[22] Filed: Sep. 14, 1995

[51] Int. Cl.[6] ..... A45D 29/06; A45D 31/00

[52] U.S. Cl. ..... 132/285; 132/73; 132/319; 132/320

[58] Field of Search ..... 132/73, 73.5, 75, 132/75.3, 75.6, 76.5, 285, 319, 320, 200; 328/56, 57, 61, 62

[56] References Cited

U.S. PATENT DOCUMENTS

| | | | |
|---|---|---|---|
| D. 178,724 | 9/1956 | Fink . | |
| D. 278,368 | 4/1985 | Valentiner . | |
| D. 300,267 | 3/1989 | McCormick . | |
| D. 309,196 | 7/1990 | LaJoie . | |
| D. 313,286 | 12/1990 | Daniels . | |
| D. 318,248 | 7/1991 | Samaras . | |
| D. 334,997 | 4/1993 | McCormick . | |
| 2,031,225 | 2/1936 | O'Donnell . | |
| 2,262,977 | 11/1941 | Vasil . | |
| 2,563,689 | 8/1951 | Muhlhauser . | |
| 3,382,878 | 5/1968 | Dinerstein . | |
| 4,287,899 | 9/1981 | Robichaud | 132/73 |
| 4,643,208 | 2/1987 | Amour . | |
| 4,665,934 | 5/1987 | Jefferson . | |
| 4,690,369 | 9/1987 | Giuliano | 132/73 |
| 4,779,632 | 10/1988 | Howa et al. | 132/73 |
| 4,924,889 | 5/1990 | Schaeffer et al. | 132/73 |

*Primary Examiner*—Gene Mancene
*Assistant Examiner*—Pedro Philogene
*Attorney, Agent, or Firm*—Donald R. Comuzzi; Christopher L. Makay

[57] ABSTRACT

An attachable member for creating sculptured nails and a method for using the same. The attachment member is designed to fit beneath the fingernail of the user upon the insertion of a template beneath the nail of the user. The template is the pattern upon which a brush-applied liquid powder acrylic mix or similar product is applied. Adjacent to the template and forming an outline for the pattern is a groove designed to define the edge and form it to a uniform thickness and shape and to catch the excess mix. Outside of the groove is an adjacent area for wiping off excess.

4 Claims, 1 Drawing Sheet

APPARATUS FOR CREATING SCULPTURED NAILS

FIELD OF THE INVENTION

A kit for use in extending a fingernail by applying nail extension material to said nail form, more specifically, a kit comprised of multiples of rigid templates and a method for using the templates to build up nails.

BACKGROUND OF THE INVENTION

Manicure is a noun, coming from the French word "manice" meaning hand and it means the treatment for the care of hands and fingernails. Indeed, for hundreds of years people, typically females, have been having their nails manicured. Typically, a manicure includes trimming and polishing the nails and occasionally painting them. The manicure often includes building out the leading edge of the nail so that the fingernails extend out further than the natural nail. Building up nails is typically done with a liquid catalyst and a powder acrylic (or other suitable material) which, when "painted on" to a paper form backing extending from the leading edge of the natural nail outward, dries quickly to form an acrylic polymer that can then be trimmed, shaped with an emery board, and polished to form a natural looking extension of the natural nail. Alternately, the acrylic polymer can be used to bond plastic nails to the border regions of the natural nail to provide an artificial extension of the nail.

However, both methods, utilizing paper forms to build out the nail from acrylic polymer or using a plastic nail bonded to the natural nail, have their drawbacks.

Using paper forms, the manicurist must be skilled in using the brush to create a natural looking extension of the fingernail in order to form an aesthetically pleasing shape. That is, the manicurist must use the brush in properly applying the catalyst powder mix to evenly extend the nail outward from the leading edge, provide a smooth curve to the side edges and nose of the nail (rounded or squared off), and then have reasonable symmetry to the nail to create an aesthetically pleasing look, which also matches the other nails on the hand. Typically, the paper forms enjoying popularity at present have a grid pattern printed on the paper surface to help outline the borders where the brush strokes should be laid. Nonetheless, use of paper forms does require a certain amount of skill and dexterity as well as creativity on the part of the manicurist in following the proper lines. Further, paper forms will sometimes collapse under the weight of the catalyst powder mix as well as the pressure from the stroking of the brush against the paper. Partial collapse means a thick buildup of the nail and/or a buildup beneath the leading edge portion of the natural nail where the paper has collapsed due to the weight of the acrylic product and/or brush pressure. With collapse of the paper form, the mix will be built up thicker in that particular area and will result in a nail which will be unnaturally thick and require extra sanding.

Where an adhesive is used to glue a plastic nail on the leading edge portion of the natural nail, other problems are encountered. Frequently, it is hard to get a smooth blend from the surface of the natural nail onto the plastic nail because of the ridge created by gluing the plastic on the top surface of the natural nail. Further, it has been found that the use of plastic nails increases the likelihood of a fungus buildup under the tip of the nail, which creates concerns for the hygiene of the wearer.

OBJECTS OF THE INVENTION

It is an object of the present invention to provide a device and method for the building up of artificial nails. The method uses a rigid template insertable beneath the leading edge of the natural nail. The template provides a pattern on which the artificial nail will be built out from the natural nail and has a groove forming the outline of the template, which groove provides a barrier for limiting the buildup area and gives shape to the artificial nail. The template also has an adjacent portion on which overbrush, beyond the template material, can be eliminated prior to drying of the acrylic powder mix. Thus, applicants provide a device and method for creating artificial nails which requires less expertise and skill to produce a pleasing artificial nail, and can be done quicker than conventional methods using conventional devices.

SUMMARY OF THE INVENTION

The present invention relates to an attachable member for use in extending a nail by applying nail extension material to a fingernail comprising a platform (comprised of an inert, nonporous, rigid material capable of nonadhesively receiving liquid acrylic thereon) having a template portion for the application of nail extension material thereto. The attachable member also comprises an adjacent portion, the template portion and the adjacent portion being separated by a groove. The groove defines the outline and thickness of the nail shape desired and the template portion has a leading edge for insertion beneath the nail to be extended.

The present invention also relates to a method of enhancing the appearance of fingernails utilizing a brush and a liquid acrylic polymer mix and comprising the steps of providing a multiplicity of attachment members, each attachment member having a template with a leading edge, an adjacent portion extending outward from the template (except at the leading edge thereof) and a groove separating the template from the adjacent portion. Each member also has means to attach the attachment members to a finger. An attachment member is inserted beneath the edge of a fingernail. A liquid acrylic polymer mix is applied to the fingernail and the attachment member with a brush. Any excess liquid acrylic polymer mix is removed from the template and the groove. The liquid acrylic polymer mix is then allowed to dry, and the attachment member is removed from the fingernail.

DETAILED DESCRIPTION OF THE PREFERRED EMBODIMENT

Applicants' attachable member may have various dimensions as set forth in more detail below.

FIGS. 1–6 illustrate various views of an attachable member 10 that may have a variety of shapes as set forth more specifically below.

Figure 1:
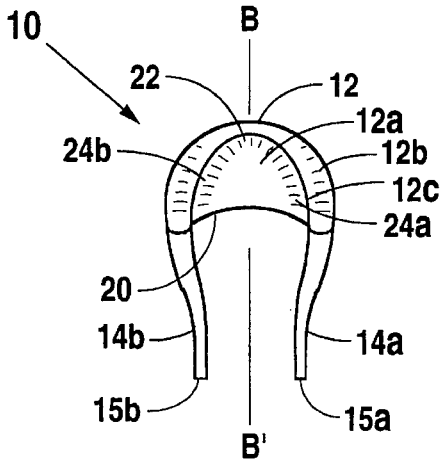
FIG. 1 is a top elevational view of an attachable member for use in preparing artificial nails.
Figure 2:
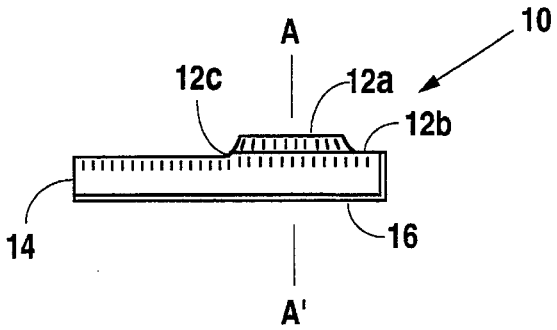
FIG. 2 is a side elevational view of the attachable member.
Figure 3:
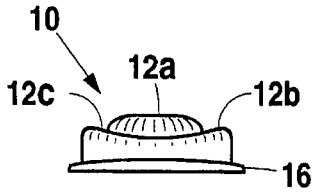
FIG. 3 is a front elevational view of the attachable member.
Figure 4:
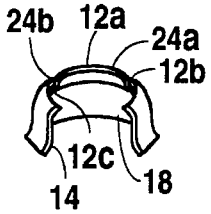
FIG. 4 is a rear elevational view of the attachable member.
Figure 6:
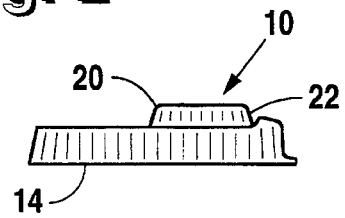
FIG. 6 is a cross-sectional, side elevational view through section B as shown in FIG. 1 of the attachable member.
Figure 5:
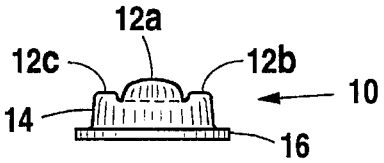
FIG. 5 is a cross-sectional elevational view along section A as shown FIG. 2 of the attachable member.

FIGS. 1–6 illustrate that applicants' attachable member (10) includes, visible especially when viewed in FIG. 1, a platform (12) which is a rigid surface typically made of polyethylene or other chemically inert, nonporous, rigid material capable of releasably receiving a liquid catalyst/powdered polymer in combination on the surface thereof. The platform (12), as well as the remainder of the attachable member (10) is typically a molded, unitary piece of such material, rigid to the extent that it can withstand the weight of a buildup of acrylic polymer as well as brush strokes on the surface thereof without deforming, which paper forms are known to do. Nonetheless, the material does exhibit flexibility, as is found in sheets of formed polyethylene. Typically, the preformed sheets have a thickness of about 0.060 inches (range 0.030 to 0.090). Typically, after the attachable member is formed, the finished thickness will vary from 0.025 to 0.075 inches.

With reference to the figures, it is seen that platform (12) is made up of two portions: a template portion (12*a*) which defines the shape of the finished nail and an adjacent border portion (12*b*) and, between the template portion (12*a*) and adjacent border portion (12*b*), a groove portion (12*c*) which defines the boundary between the template portion (12*a*) and adjacent border portion (12*b*).

Further reference to the platform (12) indicates that the surfaces of the template portion (12*a*) and adjacent border portion (12*b*) are noncoplanar and meet at the groove 18 portion (12*c*). The groove defines the outline of the intended or desired shape of the extended nail and, further, the thickness of the extended nail. Application of the acrylic mix should not extend beyond the groove. The template portion (12*a*), as stated, is intended to be the portion of the platform which defines the finished surface of the artificial nail and which is intended to receive the brush-applied buildup of the acrylic polymer and, as such, the groove portion (12*c*) defines the boundary or outline of the finished nail when viewed from above. Thus, it can be understood that, when the catalyst/powder mix is applied with a brush to the template portion (12*a*), overflow will tend to collect in the groove portion (12*c*) or adjacent border portion (12*b*); and the subsequent application of a substantially dry brush will remove any overflow of the liquid mix that accumulates or is inadvertently applied to the adjacent border portion (12*b*).

It is seen that the attachable member (10) also includes a skirt (14) depending downward from the outer perimeter of adjacent border portion (12*b*). Legs (14*a*) and (14*b*) of the skirt (14) are provided on either side of template portion (12*a*) and extend rearward beyond the platform (12) as is most readily appreciated with reference to FIGS. 1, 2 and 4.

Figure 7:
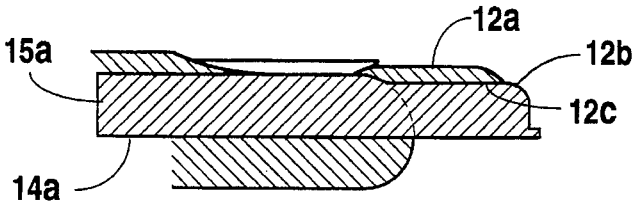
FIG. 7 is a is a side elevational view illustrating the use of the attachable member on a human fingernail.
Figure 8:
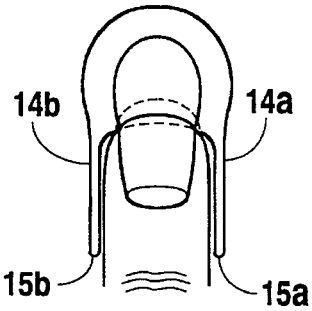
FIG. 8 is a top elevational view illustrating the use of the attachable member on a human fingernail.

As seen in FIGS. 7 and 8, legs (14*a*) and (14*b*) are somewhat flexible and assist in compressively holding attachable member (10) to the sides of the finger while the artificial nail is being built up. It can be further seen that legs (14*a*) and (14*b*) have removed ends (15*a*) and (15*b*) which are typically a distance apart that is less than the width of the finger. This allows the attachment of attachable member (10) with the inner surface of legs (14*a*) and (14*b*) compressing the sides of the finger as illustrated in FIG. 8. The use of polyethylene is found to have sufficient flexibility to compress the edges of the finger with enough force to maintain the attachable member (10) in place while in use.

It is seen that attachable member (10) also includes a flange (16) and a lip (18). The flange (16) is seen to extend outward approximately perpendicular to the side walls of skirt (14) to act as a stiffener to the skirt (14). Lip (18) is seen to extend inward along the upper edge of legs (14*a*) and (14*b*). Moreover, with reference to FIGS. 1–6, it is seen that the template portion (12*a*) has a leading edge (20) running from groove to groove (12*c*), a nose portion (22) representing the removed end of the artificially built up nail and side wall portions (24*a*) and (24*b*). Side wall portions (24*a*) and (24*b*) slope downward, as does nose portion (22) to meet the groove portion (12*c*).

FIGS. 7 and 8 illustrate the manner in which the attachable member (10) is placed onto the fingertip with the leading edge (20) beneath the nail and the skirt (14), pressing snugly against the finger. The attachable member may be squeezed or expanded and stretched so the leading edge matches the curvature of the fingernail tip. Powder acrylic and liquid catalyst, known in the art, are utilized to build up the nail. For example, liquid catalyst of the type sold as SolarNail™ by Creative Nail Design, Inc. of Carlstadt, Calif. 92009, may be used.

Therefore, in preparation for utilizing the unique attachable member (10) of applicants' invention, liquid catalyst/powder acrylic and an appropriate brush is set aside. All these items are known and available.

The method of utilizing applicants' attachable member follows.

A multiplicity of attachable members having different shaped templates with a number of different width leading edges to account for different widths of individual fingernails form a kit for use in preparing artificial nails. Attachable members have a platform wherein the length of the template (leading edge to the tip of the nose) varies, again according to the desires and needs of the individual customer. The kit will also include various shapes and lengths, including square or oval-shaped noses, again to provide for the desires of individual customers. With the kit and the supplies as set forth above, the following procedure is followed:

1. Select the appropriate attachable member size the width of the leading edge to the natural fingernail to be sculpted with the different length and nose shape selected according to the customer's desires.
2. Set the properly sized attachable member beneath the front edge of the fingernail of the customer as set forth in FIGS. 7 and 8 with the leading edge of the attachable member tucked underneath the edge of the natural nail and the member snug to the finger.
3. Dip the brush in the liquid catalyst and the powder acrylic and begin building up the nail from the leading edge forward.
4. Continue to apply liquid catalyst/powder acrylic mix across the top and side of the template to the groove in such a manner as to cover the template portion of the attachable member.
5. Brush off excess catalyst/powder mix from the adjacent portion of the attachable member.

6. Let dry.

7. Easily remove the attachable member by gently squeezing it so it pops off.

8. Sand, buff, and finish as desired.

A preferred optional method would allow the manicurist to stop short of the groove portion at the nose of the template to give a shorter nail. That is, the manicurist would simply brush from the leading edge up the sides and top of the template, but not all the way up to cover the nose.

Another preferred optional method is to build up acrylic nails ahead of time without the customer present. That is, the template is used as a pattern before the customer arrives. This makes applicants' device handy in teaching trainees in the method, with or without a finger in the attachable member. When the acrylic nails dry, they can be popped off, placed underneath or adjacent to a customer's natural nail and bonded with acrylic polymer and shaped as desired.

Figure 9:
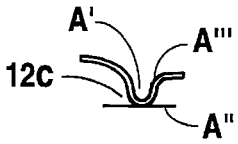
FIG. 9 is a cross-sectional view of the groove showing adjacent area and the template areas.
Figure 10:
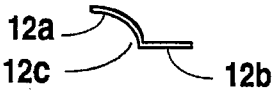
FIG. 10 is a cross-sectional view of an alternate preferred embodiment of a groove, the groove defining a border between a flat, adjacent area and curved side walls of a template.

FIGS. 9 and 10 illustrate cross sections of the groove. FIG. 9 illustrates a cross section of the groove and further illustrates that a line drawn tangent to the side walls of the template, here illustrated as A', will have a negative slope. A line drawn tangent to the lowermost portion of the groove will typically have no slope, here illustrated by line A". A line drawn tangent to the walls of the adjacent portion of the platform as they depend into the groove will typically have a positive slope, here illustrated by line A'".

FIG. 10 illustrates an alternate preferred embodiment of groove (12*c*). Here it is seen that the walls of the adjacent portion are typically horizontal and meet the walls of the side walls of the template portion at approximately 90°.

Terms such as "left," "right," "up," "down," "bottom," "top," "front," "back," "in" "out," and like are applicable to the embodiments shown and described in conjunction with the drawings. These terms are merely for purposes of description and do not necessarily apply to the position or manner in which the invention may be constructed for use.

Although the invention has been described in connection with the preferred embodiment, it is not intended to limit the invention's particular form set forth, but on the contrary, it is intended to cover such alternatives, modifications, and equivalences that may be included in the spirit and scope of the invention as defined by the appended claims.

What is claimed is:

1. An attachable member for use in preparing artificial nails, comprising:

a nail-shaped template portion;

a border portion positioned adjacent said template portion; and a groove intermediate to said template portion and said border portion for defining the outline and thickness of a nail.

2. The attachable member according to claim 1 further comprising a skirt formed integrally with said border portion wherein said skirt includes legs for securing said attachable member to a finger.

3. The attachable member according to claim 1 further comprising a lip along the lower portion of said skirt that terminates in a flange for stiffening said skirt.

4. The attachable member according to claim 1 wherein said template portion includes a nose portion and a leading edge for insertion under the tip of a nail.

* * * * *